US010532913B1

(12) United States Patent
Zhang et al.

(10) Patent No.: US 10,532,913 B1
(45) Date of Patent: Jan. 14, 2020

(54) SPROCKETS FOR PEOPLE CONVEYORS

(71) Applicant: Otis Elevator Company, Farmington, CT (US)

(72) Inventors: Huan Zhang, Glastonbury, CT (US); John P. Wesson, West Hartford, CT (US)

(73) Assignee: OTIS ELEVATOR COMPANY, Farminton, CT (US)

( * ) Notice: Subject to any disclaimer, the term of this patent is extended or adjusted under 35 U.S.C. 154(b) by 0 days.

(21) Appl. No.: 16/293,945

(22) Filed: Mar. 6, 2019

(51) Int. Cl.

| | |
|---|---|
| ***B66B 23/02*** | (2006.01) |
| ***B66B 23/10*** | (2006.01) |
| ***B66B 31/00*** | (2006.01) |
| ***B66B 21/10*** | (2006.01) |
| ***B66B 21/04*** | (2006.01) |

(52) U.S. Cl.
CPC ..... *B66B 23/026* (2013.01); *B66B 21/04* (2013.01); *B66B 21/10* (2013.01); *B66B 23/10* (2013.01); *B66B 31/00* (2013.01)

(58) Field of Classification Search
CPC ..... B66B 31/02; B66B 23/026; B66B 23/10; B66B 23/04; B66B 23/06; B66B 31/00; B66B 29/02; B66B 29/04
USPC ..... 198/833–835
See application file for complete search history.

(56) References Cited

U.S. PATENT DOCUMENTS

| | | | | |
|---|---|---|---|---|
| 3,142,192 | A | 7/1964 | Edberg | |
| 4,439,173 | A | 3/1984 | Fokos | |
| 4,553,951 | A | 11/1985 | Pavone | |
| 5,117,968 | A * | 6/1992 | Rivera | B66B 31/02 198/338 |
| 5,119,924 | A | 6/1992 | Kaminski | |
| 5,593,366 | A | 1/1997 | Puzik | |
| 6,168,544 | B1 * | 1/2001 | Barnes | F16H 55/38 198/835 |
| 6,447,225 | B1 | 9/2002 | Green | |
| 6,938,754 | B2 | 9/2005 | Kanaris | |
| 7,810,637 | B2 | 10/2010 | Gundlach | |
| 8,196,738 | B1 * | 6/2012 | Wolf | B65G 39/07 198/835 |
| 8,240,453 | B2 * | 8/2012 | Miyaji | B66B 31/02 198/335 |
| 8,579,774 | B2 * | 11/2013 | Derscheid | A01F 15/18 198/835 |
| 9,151,357 | B2 | 10/2015 | Degroot | |
| 9,382,995 | B2 | 7/2016 | Osborne et al. | |
| 2002/0046929 | A1 * | 4/2002 | Finnegan | B65G 23/06 198/834 |
| 2008/0257690 | A1 * | 10/2008 | Ozaki | B66B 23/10 198/688.1 |
| 2009/0127067 | A1 * | 5/2009 | Guo | B66B 23/24 198/337 |

(Continued)

FOREIGN PATENT DOCUMENTS

| | | | |
|---|---|---|---|
| CN | 102966723 | A | 3/2013 |
| DE | 102010027112 | A1 | 1/2012 |

(Continued)

*Primary Examiner* — Mark A Deuble
(74) *Attorney, Agent, or Firm* — Cantor Colburn LLP

(57) ABSTRACT

People conveyors and components for people conveyors are described. The components include a toothed surface having at least one tooth. The at least one tooth having an engagement surface and a surface pattern comprising pattern channels formed into the engagement surface.

19 Claims, 7 Drawing Sheets

(56) References Cited

U.S. PATENT DOCUMENTS

2013/0206550 A1* 8/2013 Gibbs ..... B65G 39/07
198/835

FOREIGN PATENT DOCUMENTS

| | | | |
|---|---|---|---|
| DE | 202014100830 | U1 | 5/2014 |
| EP | 2272320 | B1 | 11/2012 |
| WO | 2017140635 | A1 | 8/2017 |

* cited by examiner

SPROCKETS FOR PEOPLE CONVEYORS

BACKGROUND

The subject matter disclosed herein generally relates to people conveyors (e.g., moving walkways, escalators, etc.) and, more particularly, to improved sprockets for people conveyors.

Conveyors such as people conveyors (e.g., moving walkways, escalators, etc.) usually comprise a plurality of conveyance elements (e.g., pallets, steps, etc.). The conveyance elements (or at least some of such elements) are typically drivingly coupled to at least one drive element (e.g., belt, chain, etc. driven by a sprocket, gear, etc.). The belt/chain of the drive element is typically operably connected to and driven by the sprocket or similar device that rotates to drive movement of the conveyance elements. In some configurations, the drive element may include a toothed belt that engages with a toothed sprocket.

The sprocket operates in combination with a toothed belt to enable slipless, positive driving of the conveyance elements. Such systems may be subject to or experience relatively high levels of noise and/or vibration. For example, an abnormal noise may be induced when the belt/chain of the drive element engages with or disengages from the sprocket. Such noise may be generated by air that is trapped between the belt/chain and the sprocket which is rapidly expelled from a cavity that exists between the belt/chain and the sprocket (e.g., between meshed teeth of the components). Furthermore, dust particles can attach to surfaces of the sprocket and/or surfaces of the belt/chain through electrostatic and Van der Waals forces, causing wear and deterioration in the meshing conditions between the two components, which may increase noise, and may result in higher costs of maintenance and operation.

BRIEF SUMMARY

According to some embodiments, components for people conveyors are provided. The components include a toothed surface having at least one tooth. The at least one tooth includes an engagement surface and a surface pattern comprising pattern channels formed into the engagement surface.

In addition to one or more of the features described above, or as an alternative, further embodiments of the components for people conveyors may include that the toothed surface is a surface of at least one of a sprocket and a belt of a people conveyor.

In addition to one or more of the features described above, or as an alternative, further embodiments of the components for people conveyors may include that the people conveyor is one of a moving walkway and an escalator.

In addition to one or more of the features described above, or as an alternative, further embodiments of the components for people conveyors may include at least one internal feature formed within the pattern channels.

In addition to one or more of the features described above, or as an alternative, further embodiments of the components for people conveyors may include that the pattern channels include a channel base and the at least one internal feature extends from the channel base.

In addition to one or more of the features described above, or as an alternative, further embodiments of the components for people conveyors may include that the pattern channels include a channel base and the at least one internal feature is recessed from the channel base.

In addition to one or more of the features described above, or as an alternative, further embodiments of the components for people conveyors may include that the surface pattern comprises a chevron pattern.

In addition to one or more of the features described above, or as an alternative, further embodiments of the components for people conveyors may include that the surface pattern comprises a superimposed bi-direction chevron pattern.

In addition to one or more of the features described above, or as an alternative, further embodiments of the components for people conveyors may include that the pattern channels include a channel base that is recessed a depth D from the engagement surface.

In addition to one or more of the features described above, or as an alternative, further embodiments of the components for people conveyors may include that the depth D is between $10^{-2}$ mm and $10^{0}$ mm.

In addition to one or more of the features described above, or as an alternative, further embodiments of the components for people conveyors may include a coating applied to at least one of the engagement surface and the pattern channels.

In addition to one or more of the features described above, or as an alternative, further embodiments of the components for people conveyors may include that the coating comprises at least one of a diamond-like carbon coating and a nano-composite coating.

In addition to one or more of the features described above, or as an alternative, further embodiments of the components for people conveyors may include that the surface pattern comprises at least one debris escape channel.

In addition to one or more of the features described above, or as an alternative, further embodiments of the components for people conveyors may include a sweeper brush configured to contact the engagement surface.

According to some embodiments, people conveyors are provided. The people conveyors include a conveyance band having a plurality of conveyance elements attached to a belt and a sprocket configured to drive movement of the belt. At least one of the belt and the sprocket include a toothed surface having at least one tooth. The at least one tooth includes an engagement surface and a surface pattern comprising pattern channels formed into the engagement surface.

In addition to one or more of the features described above, or as an alternative, further embodiments of the people conveyors may include that the people conveyor is one of a moving walkway and an escalator.

In addition to one or more of the features described above, or as an alternative, further embodiments of the people conveyors may include at least one internal feature formed within the pattern channels.

In addition to one or more of the features described above, or as an alternative, further embodiments of the people conveyors may include that the pattern channels include a channel base and the at least one internal feature extends from the channel base or is recessed from the channel base.

In addition to one or more of the features described above, or as an alternative, further embodiments of the people conveyors may include that the surface pattern comprises one of a chevron pattern and a superimposed bi-direction chevron pattern.

In addition to one or more of the features described above, or as an alternative, further embodiments of the people conveyors may include that the pattern channels include a channel base that is recessed a depth D from the engagement surface.

In addition to one or more of the features described above, or as an alternative, further embodiments of the people conveyors may include a coating applied to at least one of the engagement surface and the pattern channels.

In addition to one or more of the features described above, or as an alternative, further embodiments of the people conveyors may include that the coating comprises at least one of a diamond-like carbon coating and a nano-composite coating.

In addition to one or more of the features described above, or as an alternative, further embodiments of the people conveyors may include that the surface pattern comprises at least one debris escape channel.

In addition to one or more of the features described above, or as an alternative, further embodiments of the people conveyors may include a sweeper brush configured to contact the engagement surface.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited by the accompanying figures in which like reference numerals indicate similar elements.

DETAILED DESCRIPTION

Figure 1:
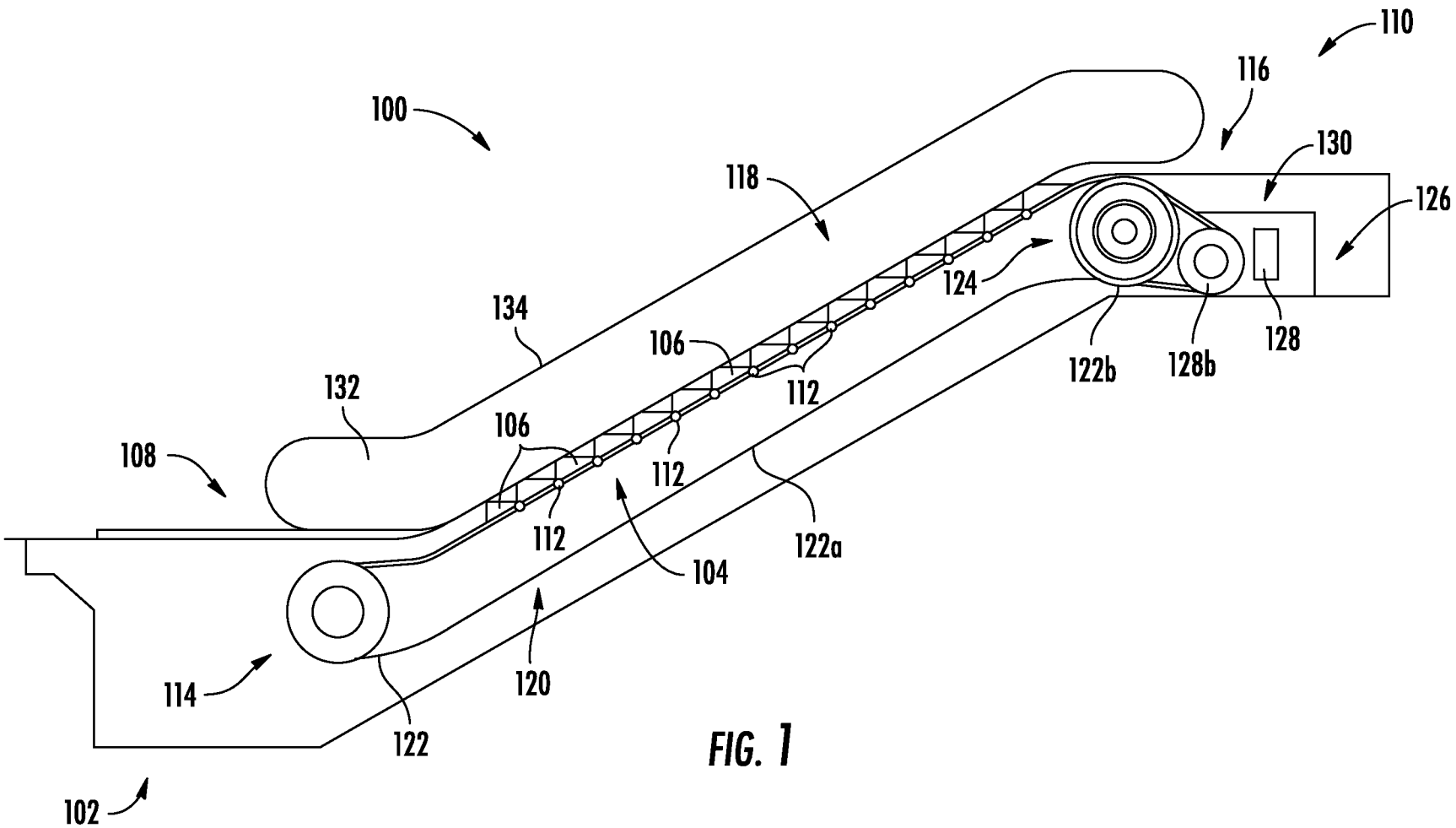
FIG. 1 is a schematic illustration of a people conveyor (escalator) that may employ various embodiments of the present disclosure.

FIG. 1 is a schematic illustration of a people conveyor 100 that may employ various embodiments of the present disclosure. As illustratively shown, the people conveyor 100 is configured as an escalator or moving stairway. The people conveyor 100 includes a truss 102 and a conveyance band 104. The conveyance band 104 includes a plurality of conveyance elements 106, arranged in this configuration as steps. The conveyance band 104 extends in a (longitudinal) conveyance direction between a first landing 108 and a second landing 110. The conveyance band 104 includes a plurality of rollers 112 which may be guided and supported by guide rails (not shown). For clarity, only some of the conveyance elements 106 are depicted in FIG. 1 and not all conveyance elements 106 and/or rollers 112 are shown and/or provided with reference signs.

The conveyance band 104 includes a first turnaround portion 114 at the first landing 108 and a second turnaround portion 116 at the second landing 110. Accordingly, the conveyance band 104 can provide a continuous motion and moving structure from the first landing 108 to the second landing 110. In operation, the conveyance band 104 defines an upper conveyance portion 118 that can convey users from the first landing 108 to the second landing 110 or vice versa, depending on a direction of operation of the conveyance band 104. The conveyance band 104 also defines a lower return portion 120.

The conveyance elements 106 are operably connected to a drive element 122. The drive element 122 may be a belt or chain driven by a sprocket, gear, sheave, or other mechanism. The drive element 122 extends along a closed loop and is configured to drive the conveyance elements 106. The drive element 122, in this embodiment, includes a belt 122*a* driven by a sheave or sprocket 122*b*. The sprocket 122*b* may in turn be driven by a drive system 126, which may include a motor 128 and a drive sheave 128*a*. The sprocket 122*b* and the drive sheave 128*a* forming a driving system 124 of the people conveyor 100. A transmission element 130 may be arranged between the motor 128 and the drive sheave 128*a* to enable controlled operation and/or driving of the sprocket 122*b*, and thus operation of the drive element 122 and the attached conveyance elements 106. In some embodiments, and as shown in FIG. 1, a balustrade 132 can support a moving handrail 134, as will be appreciated by those of skill in the art.

Figure 2:
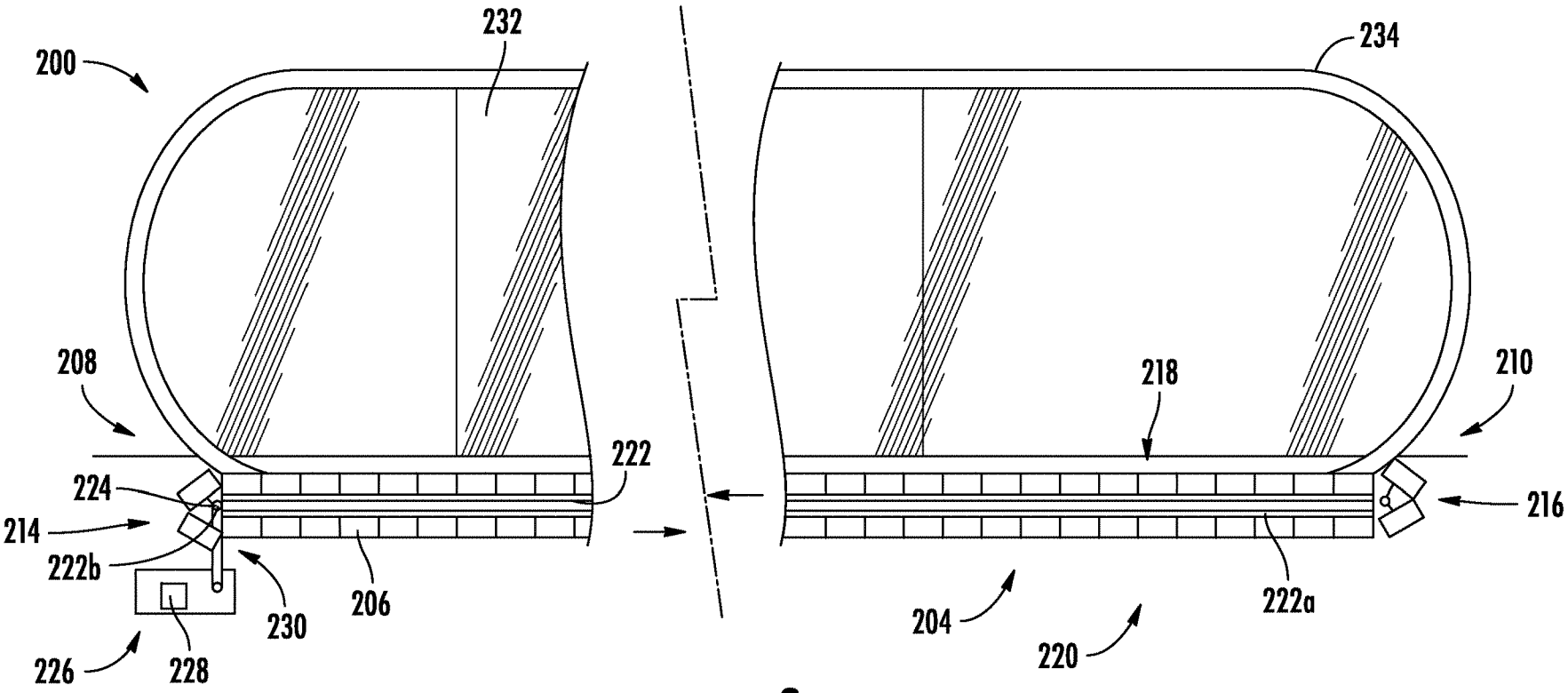
FIG. 2 is a schematic illustration of a people conveyor (moving walkway) that may employ various embodiments of the present disclosure.

Turning now to FIG. 2, a schematic illustration of a people conveyor 200 that may employ various embodiments of the present disclosure is shown. As illustratively shown, the people conveyor 200 is configured as moving walkway (i.e., level movement). The people conveyor 200 includes a conveyance band 204. The conveyance band 204 includes a plurality of conveyance elements 206, arranged in this configuration as pallets. The conveyance band 204 extends in a (longitudinal) conveyance direction between a first landing 208 and a second landing 210. In this configuration, the first and second landings 208, 210 are level with each other. The conveyance band 204 has an upper conveyance portion 218 and a lower return portion 220. For clarity, not all conveyance elements 206 are shown and/or provided with reference signs in FIG. 2.

The conveyance band 204 includes a first turnaround portion 214 at the first landing 208 and a second turnaround portion 216 at the second landing 210. Accordingly, the conveyance band 204 can provide a continuous motion and moving structure from the first landing 208 to the second landing 210. In operation, the conveyance band 204 defines the upper conveyance portion 218 that can convey users from the first landing 208 to the second landing 210 or vice versa, depending on a direction of operation of the conveyance band 204.

The conveyance elements 206 are operably connected to a drive element 222. The drive element 222 includes a chain or belt 222*a* that is operably driven by a sprocket, gear, or similar driving element 222*b*. The drive element 222 extends along a closed loop and is configured to drive the conveyance elements 206. The chain or belt 222*a* of the drive element 222 is configured to be driven by the sprocket 222*b*. The sprocket 222*b* may in turn be driven by a drive system 226 (to form a driving system 224), which may include a motor 228. A transmission element 230 may be arranged between the motor 228 and the sprocket 224 (e.g., to a sheave of the motor) to enable controlled operation and/or driving of the drive element 222. In some embodiments, and as shown in FIG. 2, a balustrade 232 can support a moving handrail 234, as will be appreciated by those of skill in the art.

Although shown in FIGS. 1-2 with example types of people conveyors, those of skill in the art will appreciate that embodiments provided and described herein can be applied to any type of conveyor. As described above, people conveyors may be subject to noise, vibrations, and/or wear. These aspects may result in maintenance costs and/or reduce ride comfort for passengers. To reduce such costs and to improve system performance, for example, embodiments of the present disclosure are directed to incorporating a hierarchical texturing to a sprocket surface to provide a mechanism for air to exit from a cavity formed between the sprocket and a belt. In one non-limiting example, a hierarchical, superimposed bi-direction chevron or hatch texture pattern may be applied to the sprocket. The pattern or texture can include a pitch and depth ranging from $10^{-2}$ to $10^{0}$ mm. Such texturing surface can be applied to the sprocket surface to alleviate the air entrapment that causes the rapid pressurization and escape. Further, such texturing may reduce the impact between the teeth of the belt and teeth of the sprocket of a drive element.

Figure 3:
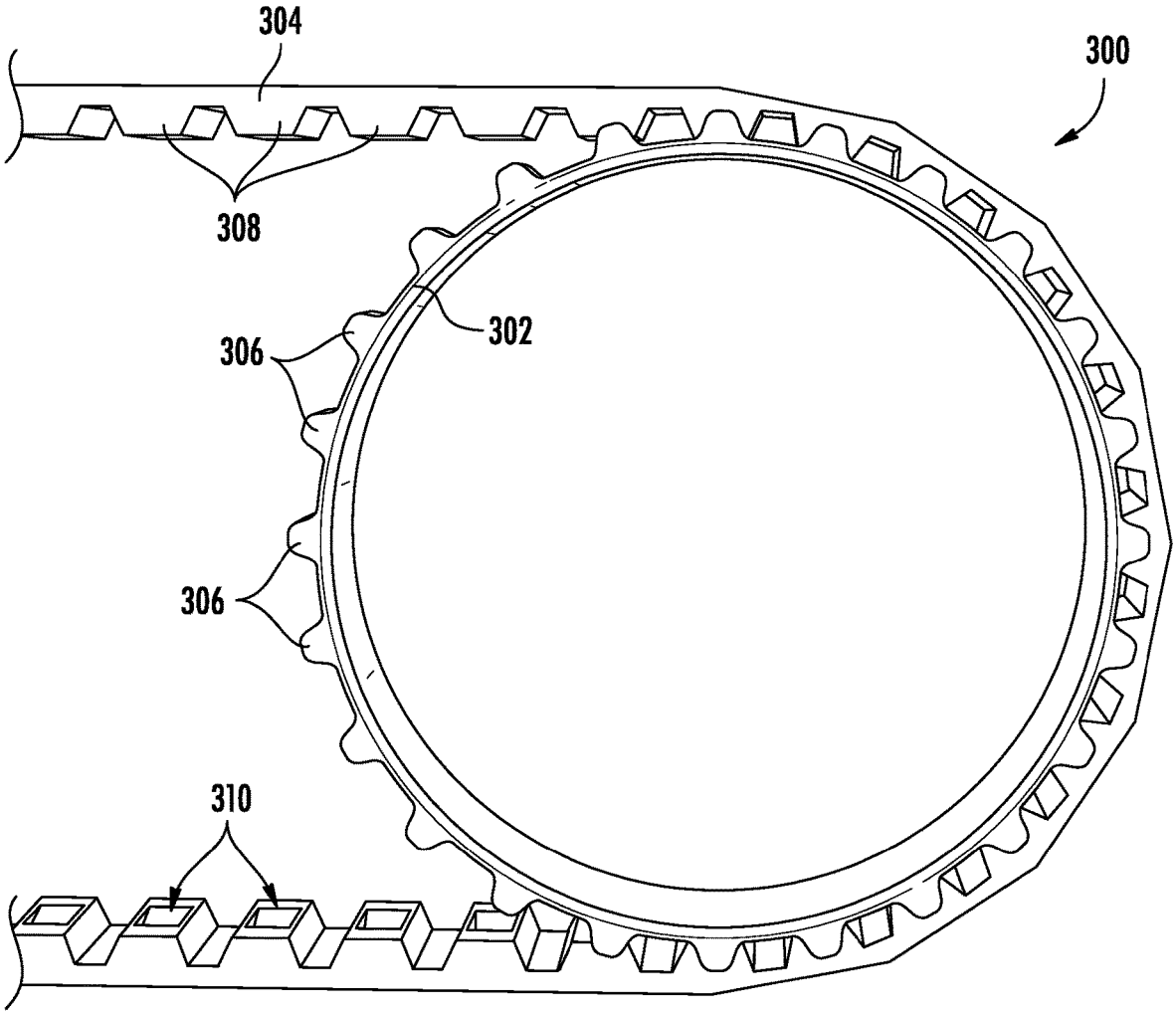
FIG. 3 is a schematic illustration of a portion of a people conveyor that may employ embodiments of the present disclosure.

Turning to FIG. 3, a drive element 300 that may incorporate embodiments of the present disclosure is shown. The drive element 300 may be configured as part of a conveyance band, as described above, and include a sprocket 302 that is operably connected to and configured to drive movement of a belt 304. Although not shown, the drive element 300 can have one or more steps or conveyance elements attached thereto, as will be appreciated by those of skill in the art. As described above, the sprocket 302 may be driven by a motor using a transmission element (not shown for clarity). As the sprocket 302 rotates, it causes movement of the belt 304. The drive element 300 may be arranged as part of a moving walkway, an escalator, or other people conveyor.

As shown, the sprocket 302 includes a plurality of first teeth 306 and the belt 304 includes a plurality of second teeth 308. That is, the sprocket 302 and the belt 304 may each have a toothed surface. In this illustrative embodiment, the first teeth 306 of the sprocket 302 are configured to engage with the second teeth 308 of the belt 304. In the illustrative embodiment of FIG. 3, each of the second teeth 308 of the belt 304 include a receiving channel 310. The receiving channels 310 are sized and shaped to receive a respective first tooth 306 of the sprocket 302. The engagement of the first teeth 306 within the receiving channels 310 of the second teeth 308 enables rotation of the sprocket 302 to cause movement of the belt 304. In other embodiments, the first teeth 306 may be configured to engage in a mesh-like manner between adjacent second teeth 308, as will be appreciated by those of skill in the art.

As noted above, the engagement of the first teeth 306 with the second teeth 308 may entrap air therebetween. Such entrapped air may generate or cause noise during operation. Further, particulates (e.g., dust, particles, debris, etc.) may adhere to or otherwise be located between the first teeth 306 and the second teeth 308 during operation. Such particulates may cause wear and/or damage to the teeth 306, 308 and/or to the sprocket 302 or belt 304. Accordingly, reduction of such impacts may be advantageous.

Figure 4A:
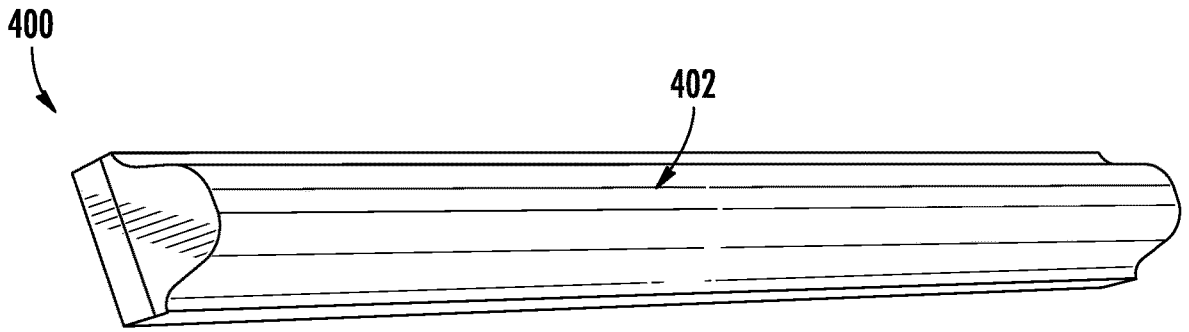
FIG. 4A is a schematic illustration of a sprocket tooth in accordance with an embodiment of the present disclosure.
Figure 4B:
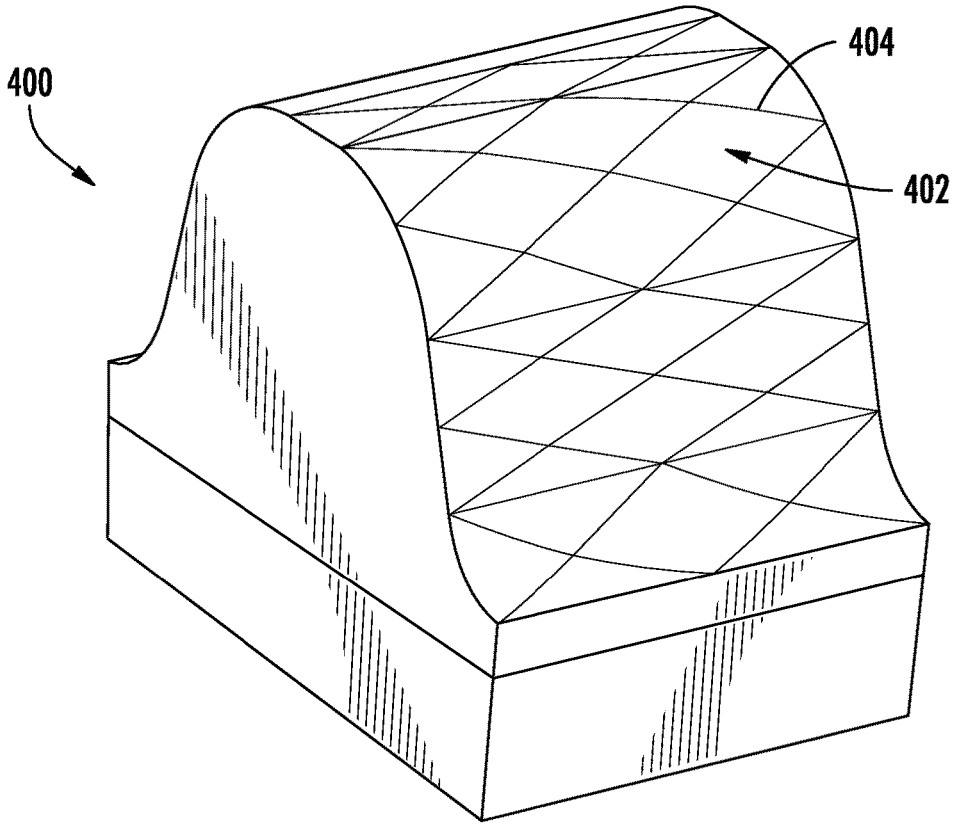
FIG. 4B is an enlarged schematic illustration of the sprocket tooth of FIG. 4A.

Turning now to FIGS. 4A-4B, schematic illustrations of a tooth 400 for use in a people conveyor in accordance with the present disclosure are shown. The tooth 400 may be a tooth of a sprocket or of a belt of a drive element. In the present description, the tooth 400 will be referred to as a tooth of a sprocket. The tooth 400 includes an engagement surface 402. The engagement surface 402 is configured to contact and engage with a respective tooth, receiving channel, or other surface of another component (e.g., of a belt). The tooth 400 is configured to transfer force through contact, and thus the engagement surface 402 is configured to contact another surface and apply or receive a force therefrom.

The tooth 400 includes a surface pattern 404 on the engagement surface 402. The surface pattern 404 may have a geometric pattern, such as chevrons, overlapping chevrons, grid-pattern, etc. The surface pattern 404 is a recessed pattern that cuts into the material of the tooth 400 and thus is reduced or recessed from the engagement surface 402. The recessed pattern is defined by pattern channels that are arranged in and form the recessed pattern. In some non-limiting embodiments, the surface pattern 404 may be a hierarchical, superimposed bi-direction chevron or hatch texture pattern. As used herein, the term hierarchical means a patterned surface with a tiered or leveled structure (i.e., hierarchical structure). For example, a hierarchical structure or pattern may be a microscale texture pattern embedded onto a higher (larger) scale pattern of similar or different geometric pattern. In some embodiments, the recessed surface pattern 404 may be formed of pattern channels having a depth of between about $10^{-2}$ mm to about $10^{0}$ mm. Furthermore, as described herein and in some embodiments, the surface pattern 404 can include internal features within the pattern channels. The internal features may be raised from or recessed from a base of the pattern channel.

Figure 5A:
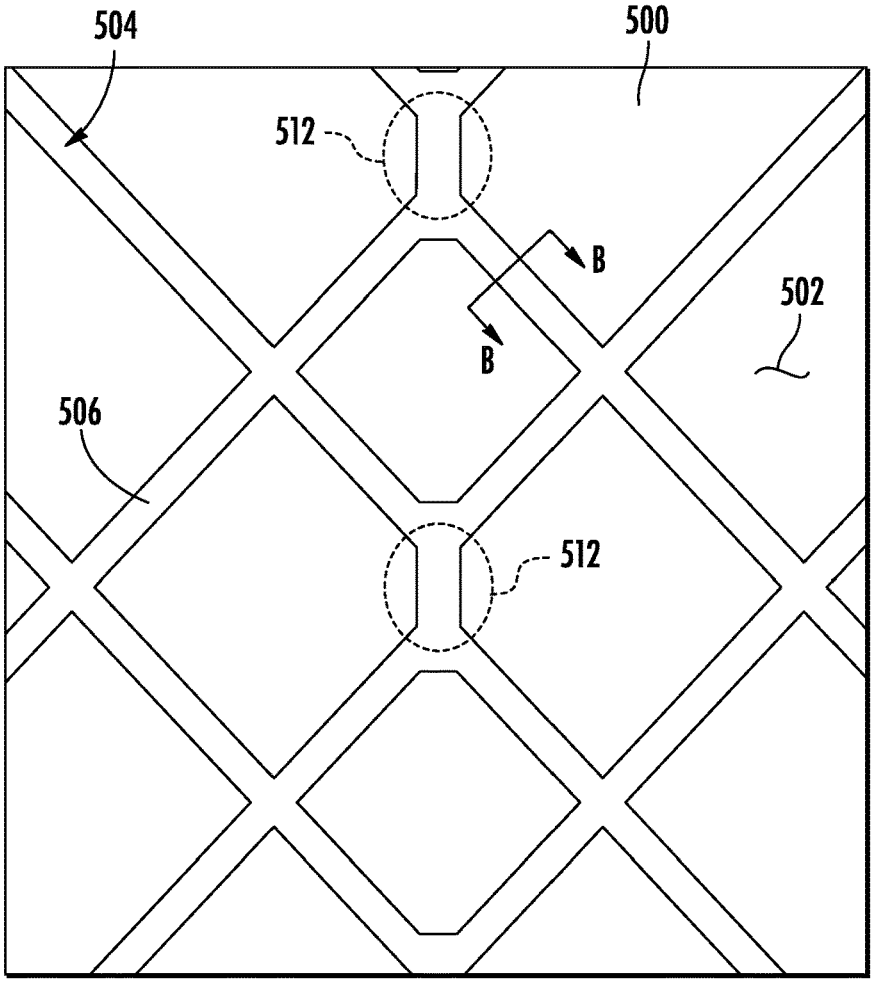
FIG. 5A is a schematic illustration of a surface pattern on a tooth in accordance with an embodiment of the present disclosure.
Figure 5B:
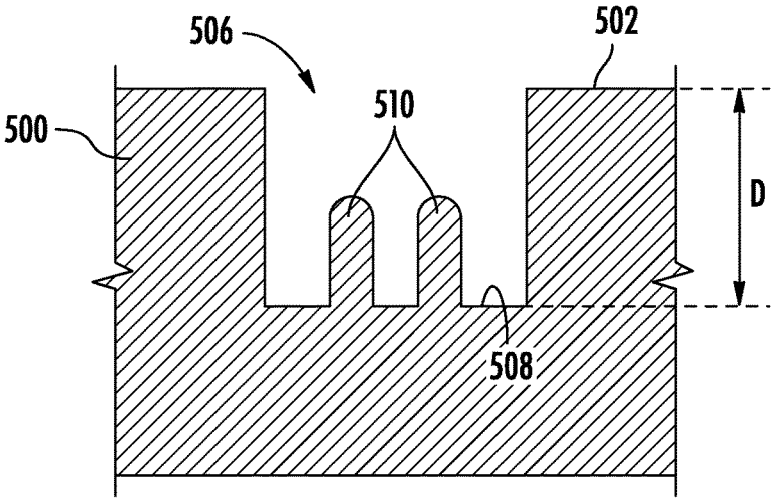
FIG. 5B is a schematic cross-sectional illustration of the tooth of FIG. 5A as viewed along the line B-B thereof.

Turning now to FIGS. 5A-5B, schematic illustrations of a tooth 500 having an engagement surface 502 with a surface pattern 504 in accordance with an embodiment of the present disclosure are shown. The tooth 500 may be a tooth of a sprocket or of a belt of a drive element of a people conveyor, as described above. The surface pattern 504 of this embodiment is an overlapping chevron pattern, although other geometric patterns may be employed without departing from the scope of the present disclosure. The surface pattern 504 comprises a sequence or system of pattern channels 506 that are formed as cuts or recesses within the material of the tooth 500.

FIG. 5B is an enlarged, cross-sectional illustration of a portion of the tooth 500 as viewed along the line B-B of FIG. 5A. As shown in FIG. 5B, the pattern channel 506 includes a channel base 508 that is recessed a depth D from the engagement surface 502. Thus, when the engagement surface 502 contacts another surface (e.g., a surface of a belt of a drive element) air that could be entrapped between the engagement surface 504 and the other surface may enter the pattern channel 506. Further, particulates, such as dust, debris, etc., can enter the pattern channel 506. Accordingly, an efficient contact and engagement between the engagement surface 504 and the other surface may be achieved.

In some embodiments, and as shown in FIG. 5B, the pattern channel 506 can include one or more internal features 510. The internal features 510 may be raised or recessed features. For example, as shown in FIG. 5B, the internal features 510 are raised structures that are raised from or extend from the channel base 508. In other embodiments, the internal features may be recessed from the channel base, such as divots or internal channels of the pattern channel 506.

Also shown in FIG. 5A is an optional debris escape channel 512. The debris escape channel 512 may be arranged to allow or permit debris or other particulates to be expelled from the pattern channels 506. As shown in this illustrative configuration, the pattern channels 506 form a bi-direction chevron pattern with the debris escape channel 512 arranged connect some of the chevron-shaped channels. Although shown in this illustration as connecting parts of the bi-direction chevron pattern of channels, in some embodiments, the optional debris escape channels may be arranged to be dead-end such that they do not connect specific parts of the pattern, but merely provide for a channel for debris and other particulates to be expelled from the pattern channels.

Figure 6:
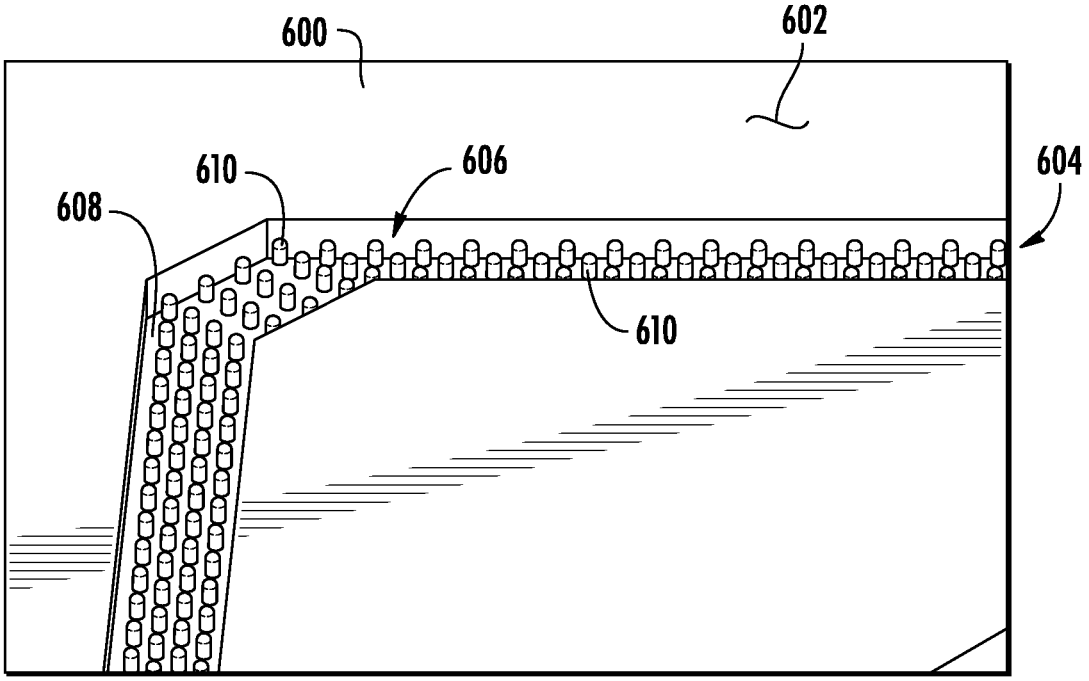
FIG. 6 is a schematic illustration of a tooth having a surface pattern in accordance with an embodiment of the present disclosure.

Turning now to FIG. 6, a schematic illustration of a tooth 600 having an engagement surface 602 with a surface pattern 604 in accordance with an embodiment of the present disclosure is shown. The tooth 600 may be a tooth of a sprocket or of a belt of a people conveyor, as described above. The pattern channel 606 includes a channel base 608 that is recessed a depth from the engagement surface 602. When the engagement surface 602 contacts another surface (e.g., a surface of a belt or sprocket) air that could be entrapped between the engagement surface 604 and the other surface may enter the pattern channel 606. Further, particulates, such as dust, debris, etc., can enter the pattern channel 606. In this illustrative embodiment, the pattern channel 606 includes internal features 610. The internal features 610 are raised structures that are raised from or extend from the channel base 608.

Figure 7:
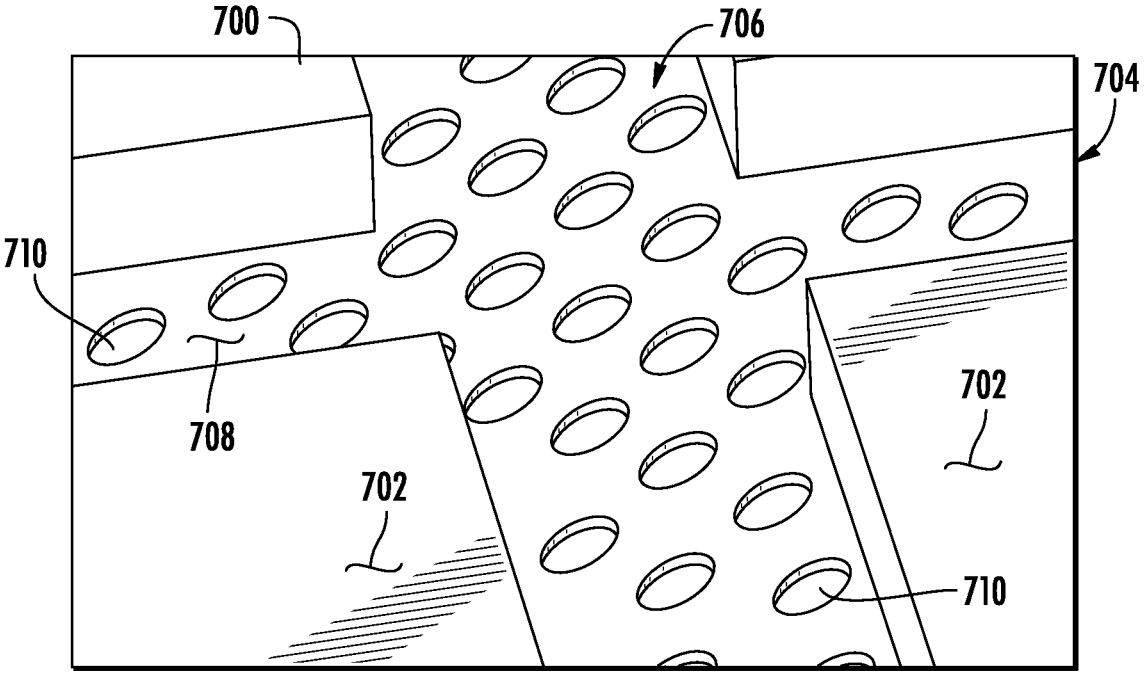
FIG. 7 is a schematic illustration of a tooth having a surface pattern in accordance with an embodiment of the present disclosure and FIG. 8 is a schematic illustration of a portion of a people conveyor in accordance with an embodiment of the present disclosure.

Turning now to FIG. 7, a schematic illustration of a tooth 700 having an engagement surface 702 with a surface pattern 704 in accordance with an embodiment of the present disclosure is shown. The tooth 700 may be may be a tooth of a sprocket or of a belt of a people conveyor, as described above. The pattern channel 706 includes a channel base 708 that is recessed a depth from the engagement surface 702. In this illustrative embodiment, the pattern channel 706 includes internal features 710. The internal features 710 are recessed structures that are recessed from or cut into the channel base 708.

Figure 8:
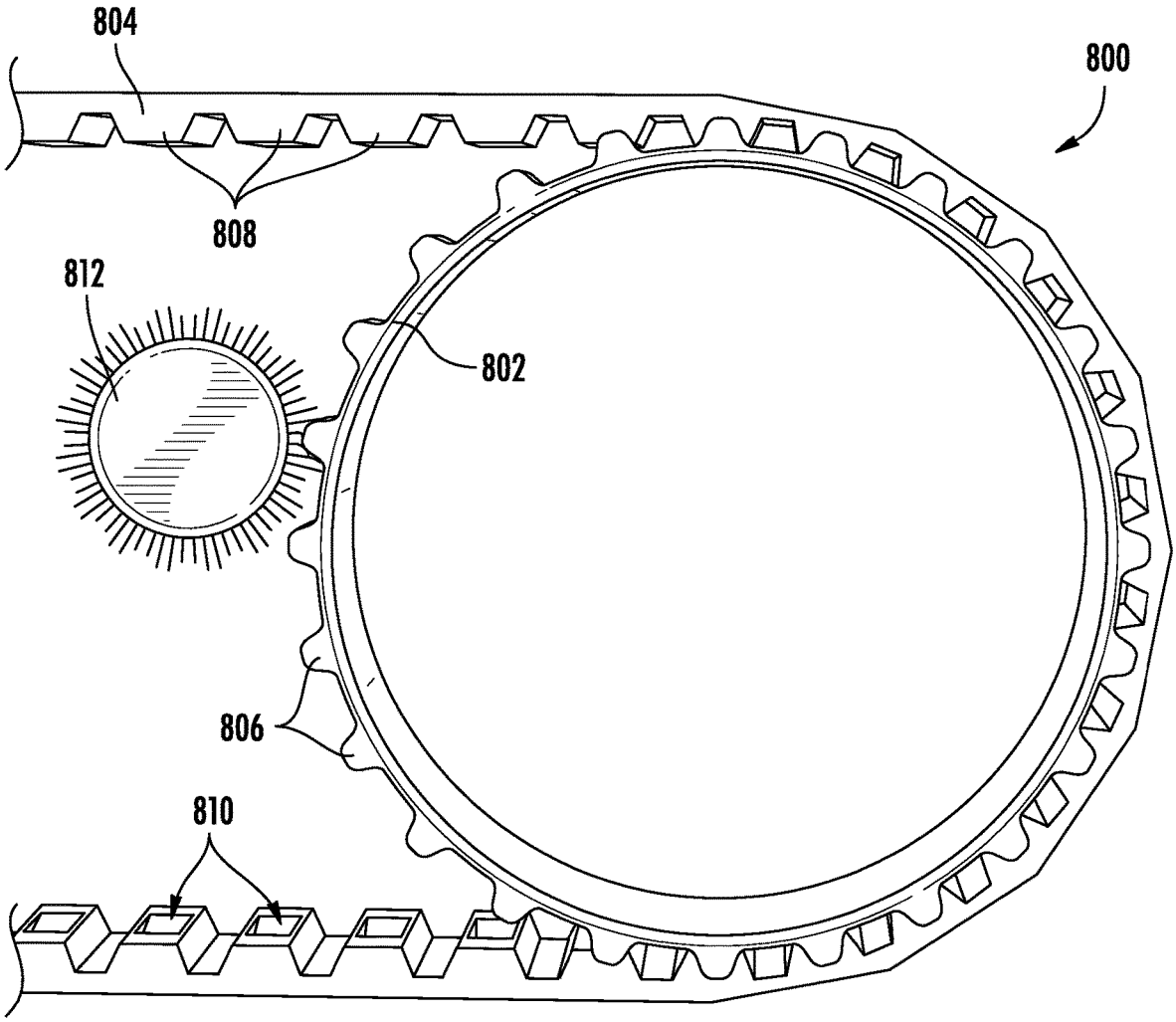

Turning now to FIG. 8, a schematic illustration of a drive element 800 in accordance with an embodiment of the present disclosure is shown. The drive element 800 may be configured as part of a conveyance band, as described above, and includes an operably connected sprocket 802 and belt 804. Although not shown, the drive element 800 can have one or more steps or conveyance elements attached thereto, as will be appreciated by those of skill in the art. As described above, the sprocket 802 may be driven by a motor using a transmission element (not shown for clarity). As the sprocket 802 rotates, it causes movement of the belt 804. The drive element 800 may be arranged as part of a moving walkway, an escalator, or other people conveyor.

As shown and similar to that described above, the sprocket 802 includes a plurality of first teeth 806 and the belt 804 includes a plurality of second teeth 808. That is, the sprocket 802 and the belt 804 may each have a toothed surface. In this illustrative embodiment, the first teeth 806 of the sprocket 802 are configured to engage with the second teeth 808 of the belt 804. In the illustrative embodiment of FIG. 8, each of the second teeth 808 of the belt 804 includes a receiving channel 810. The receiving channels 810 are sized and shaped to receive a respective first tooth 806 of the sprocket 802. The engagement of the first teeth 806 within the receiving channels 810 of the second teeth 808 enables rotation of the sprocket 802 to cause movement of the belt 804. In other embodiments, the first teeth 806 may be configured to engage in a mesh-like manner between adjacent second teeth 808, as will be appreciated by those of skill in the art.

In this embodiment, one or both of the first and second teeth 806, 808 may include patterned surfaces, as described above. The system shown in FIG. 8 also includes a sweeper brush 812 that is configured to provide a sweeping or cleaning operation to the surfaces of the teeth 806, 808. In this specific illustrative configuration, a single sweeper brush 812 is arranged to contact and brush the first teeth 806 of the sprocket 802. In other configurations, one or more additional sweeper brushes (or in the alternative) may be implemented to clean the surfaces of the teeth of the belt 804. The sweeper brush(es) are configured to not only provide contact with the surface of the teeth but also, optionally, have bristles of fine enough size to enter the pattern channels on the teeth, and potentially enter any sub-features (e.g., hierarchical pattern).

The internal features within the surface pattern described above provide for a multi-level texturing on the surfaces of the teeth of a sprocket, belt, or other toothed component of a people conveyor (i.e., hierarchical texturing/patterning). The surface patterns may be formed through honing, grinding, etching, or other processes. The internal features, which may be dimples, divots, column-like, or even secondary cross-hatch textures, can be superimposed on the first level textures by laser texturing, etching, additive processes, or other processes.

Further, in some embodiments, the tooth surface pattern can be coated with a material coating. For example, the surface pattern (and internal features thereof) may be protected with a friction-reducing and/or debris-repellent coating. The characteristics of the coated surface may be optimized with respect adhesion between the material of the textured sprocket surface (e.g., metal) and with the drive element (e.g., belt formed from thermoplastic polyurethane) and/or the difference between the static and dynamic coefficients of friction of the contact pair (i.e., a pair is a tooth of the sprocket and a tooth or receiving element of the driving element). In some embodiments, the coating may be a diamond-like carbon coating or a nano-composite coating.

Advantageously, embodiments described herein provide for improved teeth for use with components of people conveyors (e.g., escalators, moving walkways, etc.). Embodiments provided herein can enable noise reduction, robust performance and improved reliability, durability, and can lower maintenance costs.

The terminology used herein is for the purpose of describing particular embodiments only and is not intended to be limiting of the present disclosure. The term "about" is intended to include the degree of error associated with measurement of the particular quantity and/or manufacturing tolerances based upon the equipment available at the time of filing the application. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A component for a people conveyor, the component comprising:

a toothed surface having at least one tooth; and wherein the at least one tooth comprises:

an engagement surface;

a surface pattern comprising pattern channels formed into the engagement surface; and at least one internal feature formed within the pattern channels wherein the pattern channels include a channel base and the at least one internal feature is recessed from the channel base.

2. The component of claim 1, wherein the toothed surface is a surface of at least one of a sprocket and a belt of a people conveyor.

3. The component of claim 2, wherein the people conveyor is one of a moving walkway and an escalator.

4. The component of claim 1, wherein the at least one internal feature further comprises at least one feature extending from the channel base.

5. The component of claim 1, wherein the surface pattern comprises a chevron pattern.

6. The component of claim 1, wherein the surface pattern comprises a superimposed bi-direction chevron pattern.

7. The component of claim 1, wherein the pattern channels include a channel base that is recessed a depth D from the engagement surface.

8. The component of claim 7, wherein the depth D is between 10-2 mm and 100 mm.

9. The component of claim 1, further comprising a coating applied to at least one of the engagement surface and the pattern channels.

10. The component of claim 9, wherein the coating comprises at least one of a diamond-like carbon coating and a nano-composite coating.

11. The component of claim 1, wherein the surface pattern comprises at least one debris escape channel.

12. A people conveyor comprising:

a conveyance band having a plurality of conveyance elements attached to a belt; and a sprocket configured to drive movement of the belt, wherein at least one of the belt and the sprocket comprise:

a toothed surface having at least one tooth; and wherein the at least one tooth comprises:

an engagement surface; and a surface pattern comprising pattern channels formed into the engagement surface, wherein the surface pattern comprises one of a chevron pattern and a superimposed bi-direction chevron pattern.

13. The people conveyor of claim 12, wherein the people conveyor is one of a moving walkway and an escalator.

14. The people conveyor of claim 12, further comprising at least one internal feature formed within the pattern channels.

15. The people conveyor of claim 12, wherein the pattern channels include a channel base that is recessed a depth D from the engagement surface.

16. The people conveyor of claim 12, further comprising a coating applied to at least one of the engagement surface and the pattern channels.

17. The people conveyor of claim 14, wherein the at least one internal feature is recessed from the channel base.

18. The people conveyor of claim 14, wherein the at least one internal feature extends from the channel base.

19. The people conveyor of claim 12, further comprising a sweeper brush configured to contact the engagement surface of the at least one tooth.

* * * * *